US010907455B2

(12) United States Patent
Segerstrom

(10) Patent No.: US 10,907,455 B2
(45) Date of Patent: Feb. 2, 2021

(54) SYSTEM AND PROCESS FOR RECOVERING HYDROCARBONS USING A SUPERCRITICAL FLUID

(71) Applicant: Chevron U.S.A. Inc., San Ramon, CA (US)

(72) Inventor: John A. Segerstrom, Ventura, CA (US)

(73) Assignee: Chevron U.S.A. Inc., San Ramon, CA (US)

( * ) Notice: Subject to any disclaimer, the term of this patent is extended or adjusted under 35 U.S.C. 154(b) by 509 days.

(21) Appl. No.: 13/763,458

(22) Filed: Feb. 8, 2013

(65) Prior Publication Data

US 2014/0224491 A1 Aug. 14, 2014

(51) Int. Cl.
*E21B 43/24* (2006.01)
*E21B 36/00* (2006.01)

(52) U.S. Cl.
CPC ..... *E21B 43/24* (2013.01); *E21B 36/00* (2013.01)

(58) Field of Classification Search
CPC ..... E21B 36/00; E21B 43/24
USPC ..... 166/303
See application file for complete search history.

(56) References Cited

U.S. PATENT DOCUMENTS 4,648,455 A * 3/1987 Luke ..... 166/303
5,984,010 A * 11/1999 Elias et al. ..... 166/272.3
2003/0062163 A1* 4/2003 Moulton et al. ..... 166/302
2005/0126784 A1* 6/2005 Dalton ..... 166/304
2008/0302523 A1* 12/2008 Wegener et al. ..... 166/63
2009/0139715 A1* 6/2009 Choi ..... C10G 9/00 166/272.1
2009/0236092 A1* 9/2009 O'Brien ..... E21B 43/2406 166/256
2010/0031653 A1* 2/2010 Foppe ..... E21B 7/15 60/641.3
2010/0163226 A1* 7/2010 Zornes ..... 166/268
2010/0288497 A1* 11/2010 Burnham ..... E21B 43/30 166/303
2011/0036580 A1* 2/2011 Morrow et al. ..... 166/305.1
2011/0180262 A1* 7/2011 O'Dowd ..... 166/303
2011/0198078 A1* 8/2011 Harrigan et al. ..... 166/254.2

OTHER PUBLICATIONS

Morimoto et al. Effect of Supercritical Water on Upgrading Reaction of Oil Sand Bitumen (2010).*
PCT Patent Publication WO 2013/050075 A1 with publication date Apr. 11, 2013.

* cited by examiner

*Primary Examiner* — Angela M DiTrani Leff
*Assistant Examiner* — Avi T Skaist

(57) ABSTRACT

A process is provided for recovering hydrocarbons, such as heavy oils, from a subterranean reservoir. The process includes providing a supercritical aqueous fluid at a high temperature and high pressure to the underground hydrocarbon reservoir, injecting the aqueous fluid into the reservoir to heat the hydrocarbons in the reservoir, and recovering the heated hydrocarbons from the reservoir. In some cases, the supercritical fluid is also used to upgrade the hydrocarbons and/or facilitate the transportation of the hydrocarbons from the production field to another location, such as a refinery.

13 Claims, 2 Drawing Sheets

SYSTEM AND PROCESS FOR RECOVERING HYDROCARBONS USING A SUPERCRITICAL FLUID

TECHNOLOGICAL FIELD

The present disclosure relates to a process for recovering hydrocarbon fluids and, in some cases, partially upgrading and/or transporting the hydrocarbon fluids. More particularly, the present disclosure relates to a process for recovering, partial upgrading and transporting hydrocarbons using an aqueous fluid at supercritical conditions.

BACKGROUND

Oil recovered, or produced, and transported from a significant number of oil reserves around the world is simply too heavy to flow under reservoir and ambient conditions. This makes it challenging to bring remote, heavy oil resources closer to the markets where refining facilities are accessible.

In order to render such heavy oils flowable in the reservoir and production well(s), one conventional method known in the art is to use two phase saturated steam generation and distribution. That method typically presents a challenge in achieving sufficiently uniform distribution of latent heat in the reservoir. Latent heat profile control devices are known and used in the industry to distribute vapor and liquid phases more evenly at the perforations; however, installation and retrieval this equipment can be increase the complexity and cost of a hydrocarbon production operation, and the difficulty of installing and retrieving the equipment can be further increased in horizontal wells by the bend radius at the heel of the well and the sand that can settle to the bottom of the casing.

Once heavy oil is produced from a well, it is conventional practice in the industry to facilitate the transport of the heavy oil by heating it to a high temperature and maintaining high pressure in insulated shipping pipelines.

Also, in order to render such heavy oils flowable, one common method known in the art is to reduce the viscosity and density of the heavy oil by mixing the heavy oil with a sufficient diluent. The diluent may be naphtha, syncrude, or any other fluid stream that has a sufficiently higher API gravity (i.e., much lower density) than the heavy oil. Typically, this heavy oil must be taken to an upgrader either in the field or at some remote central location before shipment to a refinery.

In one conventional heavy oil production operation, diluted crude oil is sent from the production wellhead via a pipeline to an upgrading facility. Two key operations occur at the upgrading facility: (1) the diluent stream is recovered and recycled back to the production wellhead in a separate pipeline, and (2) the heavy oil is upgraded with suitable technology known in the art (coking, hydrocracking, hydrotreating, or the like) to produce higher-value products for market. Some typical characteristics of these higher-value products include: lower sulfur content, lower metals content, lower total acid number (TAN), lower residuum content, higher API gravity, and lower viscosity. Most of these desirable characteristics are achieved by reacting the heavy oil with hydrogen gas at high temperatures and pressures in the presence of a catalyst. Depending on the location of the upgrading facility and other market factors, the upgraded crude might be sent to the end-users via tankers and/or additional pipelines.

These diluent addition/removal processes and hydrogen-addition or other upgrading processes can be undesirable in some cases. For example, the infrastructure required for the handling, recovery, and recycling of diluent can be expensive, especially over long distances, and diluent may not be readily availability at a reasonable price. The hydrogen-addition processes such as hydrotreating or hydrocracking typically require significant investments in capital and infrastructure which add to the total cost of producing the heavy oil. The hydrogen-addition processes also typically have high operating costs, since hydrogen production costs are highly sensitive to natural gas prices. Some remote heavy oil reserves may not even have access to sufficient quantities of low-cost natural gas to support a hydrogen plant. These hydrogen-addition processes also generally require expensive catalysts and resource intensive catalyst handling techniques, including catalyst regeneration. In some cases, the refineries and/or upgrading facilities that are located closest to the production site may have neither the capacity nor the facilities to accept the heavy oil. Additionally, coking is often used at refineries or upgrading facilities. Sulfur is removed prior to the coking process, and significant amounts of by-product solid coke are produced during the coking process, leading to lower liquid hydrocarbon yield. In addition, the liquid products from a coking plant often need further hydrotreating. Further, the volume of the product from the coking process is significantly less than the volume of the feed crude oil.

For these and other reasons, there exists a continued need for improved systems and processes for recovering hydrocarbon fluids, particularly heavy oils.

SUMMARY OF THE INVENTION

The present disclosure provides a system and process for recovering hydrocarbons using a supercritical fluid, such as supercritical water.

In one embodiment, the system a source for providing a first aqueous fluid, such as drinking water, treated wastewater, untreated wastewater, river water, lake water, seawater, or produced water. The system also includes a heater for receiving the first aqueous fluid and heating the first aqueous fluid to a temperature from 374° C. to 1000° C. at a pressure from 3205 to 10000 psia, such that the first aqueous fluid is in a supercritical phase, a delivery system configured to receive the first aqueous fluid from the heater and delivery the first aqueous fluid for injection into an underground hydrocarbon reservoir in the supercritical phase, and a well configured to recover from the reservoir hydrocarbons that have been heated by the first aqueous fluid. One or more venturi chokes can be disposed in the reservoir, e.g., in a horizontal portion of a well that extends through at least part of the reservoir, and configured to inject the supercritical, dense-phase fluid so that the first aqueous fluid flashes across the venturi choke(s) as it is injected.

In some cases, the system is configured to mix a second aqueous fluid with the recovered hydrocarbons at conditions sufficient to upgrade at least a portion of the hydrocarbons. The system can be configured to provide the second aqueous fluid in a supercritical phase.

The present disclosure also provides a process for recovering hydrocarbons, such as whole heavy petroleum crude oil and tar sand bitumen. According to one embodiment, the process includes providing a first aqueous fluid in a supercritical phase at a temperature from 374° C. to 1000° C. and a pressure from 3205 to 10000 psia to an underground hydrocarbon reservoir. The first aqueous fluid can be drinking water, treated wastewater, untreated wastewater, river water, lake water, seawater, produced water, or mixtures thereof. The first aqueous fluid is injected into the underground hydrocarbon reservoir to heat the hydrocarbons. The heated hydrocarbons are recovered from the reservoir. In some cases, the step of injecting the first aqueous fluid includes delivering the first aqueous fluid through a wall of a wellbore (e.g., through a venturi choke installed in the wall of the wellbore) to the hydrocarbon reservoir in the supercritical phase. For example, the first aqueous fluid can flash across a venturi choke from a steam or fluid injector into the underground hydrocarbon reservoir, such as by flashing the first aqueous fluid to at least 70% steam quality.

In some embodiments, the process also includes mixing a second aqueous fluid with the recovered hydrocarbons at conditions sufficient to upgrade at least a portion of the hydrocarbons. The second aqueous fluid can be in the supercritical phase, and/or the mixing of the fluids can occur in a wellbore or production pipeline. The step of upgrading can include reducing the viscosity of at least a portion of the hydrocarbons. For example, the upgrade operation can be characterized by a reaction residence time from 8 minutes to 2 hours. The first aqueous fluid and the second aqueous fluid can be generated individually or in a single supercritical fluid generation operation, e.g., from a modified steam generator or modified heat recovery steam generator. In some cases, the first aqueous fluid and the second aqueous fluid are generated from a 50 MMBTU/HR modified oilfield steam generator. One or more heat exchangers, e.g., achieved in a wellbore or pipeline or other similar equipment can be used to achieve heat exchange between the second aqueous stream and the recovered hydrocarbons before mixing.

DETAILED DESCRIPTION

The present disclosure now will be described more fully hereinafter with reference to the accompanying drawings, in which some, but not all embodiments are shown. Indeed, these embodiments may be embodied in many different forms and should not be construed as limited to the embodiments set forth herein; rather, these embodiments are provided so that this disclosure will satisfy applicable legal requirements. Like numbers refer to like elements throughout.

Figure 1:
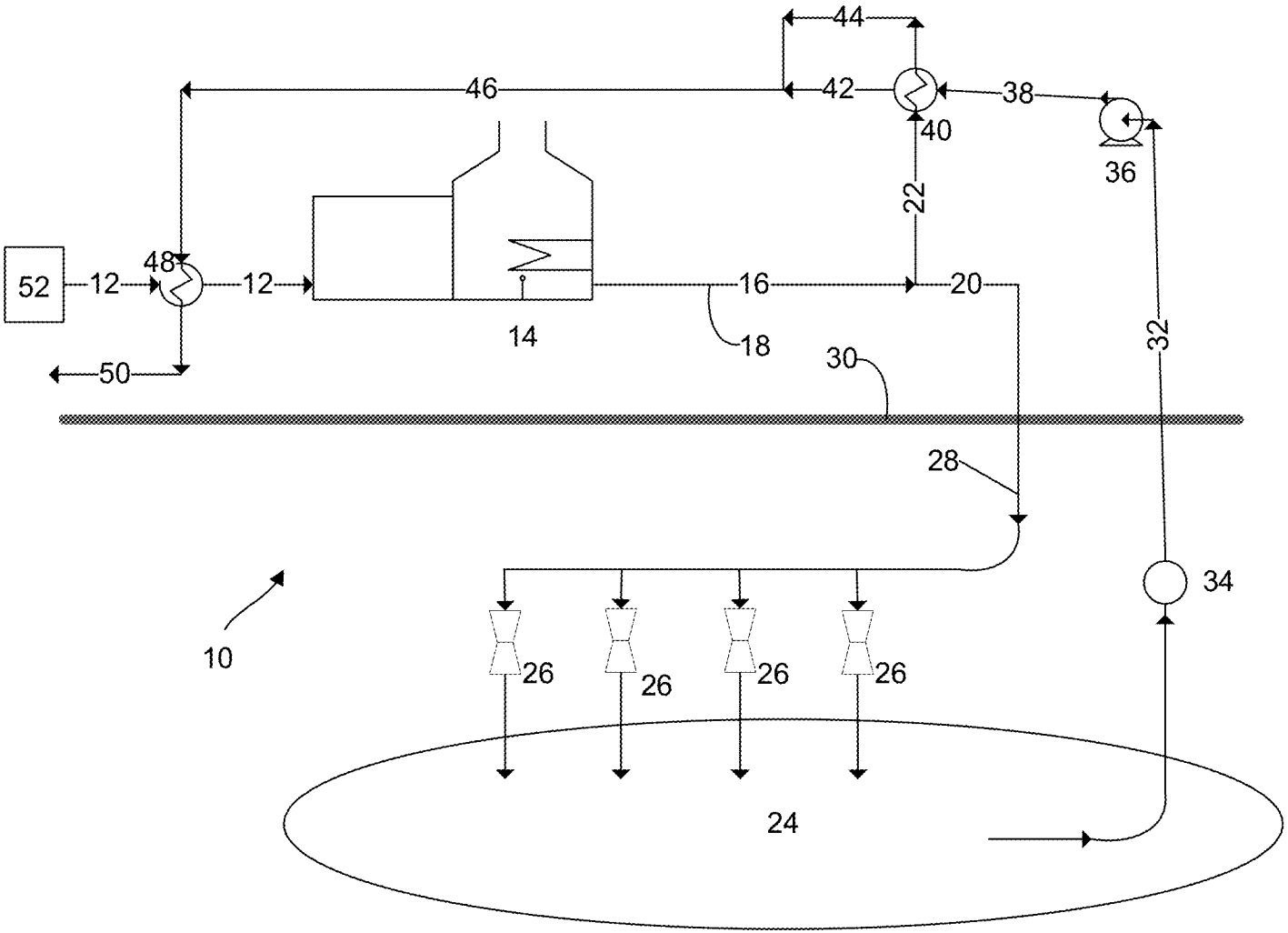
FIG. 1 is a schematic illustration of a system according to one embodiment of the present disclosure, showing a process for recovery and partial upgrading for transportation of hydrocarbon fluids.

Embodiments describing the process of the present disclosure are referenced in FIG. 1. More specifically, the following embodiments describe a system 10 and processes for implementing the present disclosure.

In the system 10 of FIG. 1, a stream of aqueous fluid, i.e., boiler feed water 12, is input from a source 52 into a water heater 14 for a heating operation. Examples of the boiler feed water include drinking water, treated wastewater, untreated wastewater, river water, lake water, seawater, produced water (such as from a hydrocarbon production operation) or mixtures thereof, and it is appreciated that the boiler feed water can include water with various materials dissolved or otherwise contained in it. The boiler feed water 12 is typically provided in a liquid phase and in the temperature range of about 0 to 100° C.

Examples of the water heater 14 include oilfield-type steam generators and gas turbine/generator cogeneration heat recovery steam generators, modified to heat the feed water 12 to supercritical conditions. In particular, the water heater 14 can be modified with upgraded tubing materials and schedules designed for high pressure in the range of about 3205 to 4060 psig and a temperature in the range of about 374° C. to 455° C. and a capacity in the range of about 50 to 150 mmbtu/hr or higher. In one embodiment based on this design, the heating operation performed in the water heater 14 generates high pressure, dense phase fluid at a temperature from 374 to 1000° C. and a pressure from 3205 to 10000 psia. At these conditions, the aqueous fluid is considered to be in a supercritical dense phase.

A stream of the supercritical dense phase fluid 16 resulting from the heating operation is output from the water heater 14 into a delivery system 18, such as high pressure piping having a diameter in the range of about 6 to 61 cm. Based on this design, supercritical dense phase fluid can be distributed for long distances, and there is typically no longer a need for equal phase splitting to maintain steam quality in the distribution system 18 as is typically performed in conventional sub-critical two-phase steam delivery systems. Although the requirements for the pipe material strength and wall thickness of the pipes used in the delivery system 18 may be relatively greater than those used in conventional sub-critical delivery systems, the overall cost of the system can be substantially reduced due to the lower loop stresses and cost of smaller diameter piping. Also, as long as the pressure is adequately maintained in the delivery system 18, there is less potential for transient water head impact and resulting vibrations ("steam hammer" effects) that are experienced in conventional delivery systems, and any vibrations and acoustics generated by such steam hammer effects would typically act on smaller piping surface areas with smaller forces in the present delivery system 18 as compared to the larger internal piping surfaces and steam hammer forces associated with conventional sub-critical delivery systems.

The stream 16 from the heater 14 is split into first and second streams of aqueous fluids, such as a reservoir feed stream 20 and a wellbore or pipeline feed stream 22 as shown in FIG. 1. The feedrate split ratio (expressed as the mass flow rate of the reservoir feed stream to the mass flow rate of the pipeline feed stream) is typically in the range of about 1:0.5 to 1:2, typically depending upon the maturity of the steamflood.

The reservoir feed stream 20 is injected into a subterranean reservoir 24 via one or more venturi chokes 26 or other appropriate choking devices. The system 10 can be used to deliver the feed stream 20 to a variety of different types of reservoirs. In some representative examples, the reservoir 24 is a sandstone, diatomite, shale oil, or carbonate heavy petroleum crude oil or tar sand bitumen reservoirs.

The one or more venturi chokes 26 are typically installed in a well 28 that extends subterraneously at least partially vertically and/or horizontally from the ground surface 30, such as in the horizontal portion of the well 28 illustrated in FIG. 1. In one embodiment, the venturi choke 26 includes a hardened steel alloy or tungsten carbide coated venturi choke projectile that can be installed with a perforating gun that perforates the steel and concrete casing of the well after the well is drilled and completed, typically by disposing a string of steel casing or liner in the well and surrounding it with concrete. If the chokes 26 are installed in this manner, it is not necessary to use well bore equipment, such as wellbore latent heat profile control devices, and this can simplify the installation, particularly in horizontal wells where installing and retrieving tubing and cup-packer chokes can be difficult due to the heel bend (or other nonlinearities along the length of the well) and build-up of sand at the bottom of the casing.

As the reservoir feed stream 20 passes though the venturi choke(s) 26, at least a portion of the supercritical phase water flashes to higher quality steam at the reservoir conditions. In one embodiment, the supercrictical phase water flashes to a range of about 70 to 100% steam quality or, superheated steam, across the venturi choke 26. Additionally, if there is near wellbore damage that reduces permeability in a particular area, the venturi choke 26 can aid recovery, e.g., 70% of the initial pressure (as provided at the outlet of the water heater 14 to the delivery system 18), such that the injected fluid has ample pressure for near-wellbore reservoir fracture and drive mechanisms.

A stream of hydrocarbon fluids 32 is recovered from the reservoir 24, typically via a submersible pump 34 and/or a high pressure pump 36 at a pressure in the range of about 3200 to 3500 psig at the pump 36 discharge and is output into a high pressure producer wellbore or oil gathering pipeline stream 38. The producer wellbore or high pressure oil gathering pipeline stream 38 can be heated via a heat exchanger 40 to a temperature in the range of about 374 to 400° C. by thermal transfer from the pipeline feed stream 22, and the stream 38 is thereby heated to form an output stream 42.

The pipeline feed stream 22 is output from the heat exchanger 40 as an output stream 44. In one embodiment, the stream 44 is mixed with stream 42, thereby resulting in the mixing of the supercritical phase water of stream 44 and the hydrocarbons of stream 42. The oil and water from streams 38 and 22 should typically have sufficient thermal energy and be subject to sufficient mixing so that the combined stream 46 has conditions sufficient to upgrade at least a portion of the hydrocarbons as it flows through a wellbore or production pipeline downstream of the mixing.

After the two streams 42, 44 are mixed; they are allowed to react under temperature and pressure conditions of supercritical water, i.e., supercritical water conditions, in the absence of externally added hydrogen, for a residence time sufficient to allow at least partial upgrading reactions to occur. The reaction can be allowed to occur in the absence of externally added catalysts or promoters, or such catalysts and promoters can be used in accordance with other embodiments of the present disclosure.

"Hydrogen" as used herein in the phrase, "in the absence of externally added hydrogen," means hydrogen gas. This phrase is not intended to exclude all sources of hydrogen that are available as reactants. Other molecules, such as saturated hydrocarbons, may act as a hydrogen source during the reaction by donating hydrogen to other unsaturated hydrocarbons. In addition, $H_2$ may be formed in-situ during the reaction through steam reforming of hydrocarbons and water-gas-shift reaction.

Supercritical water conditions typically include a temperature from 374° C. (the critical temperature of water) to 1000° C., preferably from 374° C. to 600° C. and most preferably from 374° C. to 455 C, a pressure from 3,205 (the critical pressure of water) to 10,000 psia, preferably from 3,205 psia to 7,200 psia and most preferably from 3,205 to 4,060 psia, an oil/water volume ratio from 1:0.1 to 1:10, preferably from 1:0.5 to 1:3 and most preferably about 1:1 to 1:2.

The reactants of the combined stream 46 are allowed to react under these conditions for a sufficient time to allow at least partial upgrading reactions to occur, i.e., for a reduction in viscosity. The residence time can be selected to allow the upgrading reactions to occur selectively and to the fullest extent without having undesirable side reactions of coking or residue formation. Typical residence times may be from 1 minute to 6 hours, preferably from 8 minutes to 2 hours and most preferably from 20 to 40 minutes.

While not being bound to any theory of operation, it is believed that a number of upgrading reactions are occurring simultaneously at the supercritical reaction conditions used in the present process. In a preferred embodiment of the disclosure the major chemical upgrading reactions are believed to be:

Thermal Cracking: $C_xH_y \rightarrow$ lighter hydrocarbons

Steam Reforming: $C_xH_y+2xH_2O=xCO_2+(2x+y/2)H_2$

Water-Gas-Shift: $CO+H_2O=CO_2+H_2$

Demetalization: $C_xH_yNi_w+H_2O/H_2 \rightarrow NiO/Ni(OH)_2+$ lighter hydrocarbons Desulfurization: $C_xH_yS_z+H_2O/H_2=H_2S+$lighter hydrocarbons The exact pathway may depend on the wellbore or pipeline conditions (temperature, pressure, oil/water volume ratio) and the hydrocarbon feedstock.

The combined stream 46 is input to a heat exchanger 48, in which thermal energy from the combined stream is transferred to the stream of boiler feed water 12, thereby cooling the production hydrocarbons in the combined stream 46 and preheating the boiler feed water 12 before the feed water 12 enters the water heater 14. The pressure of the combined stream 50 exiting the heat exchanger 48 can be reduced to an appropriate pressure for transportation of the partially upgraded, lower viscosity production stream to an upgrader or refinery for further processing. In some cases, the upgrading accomplished by the combination of the streams 38, 22 can eliminate the need for a conventional field upgrader.

Figure 2:
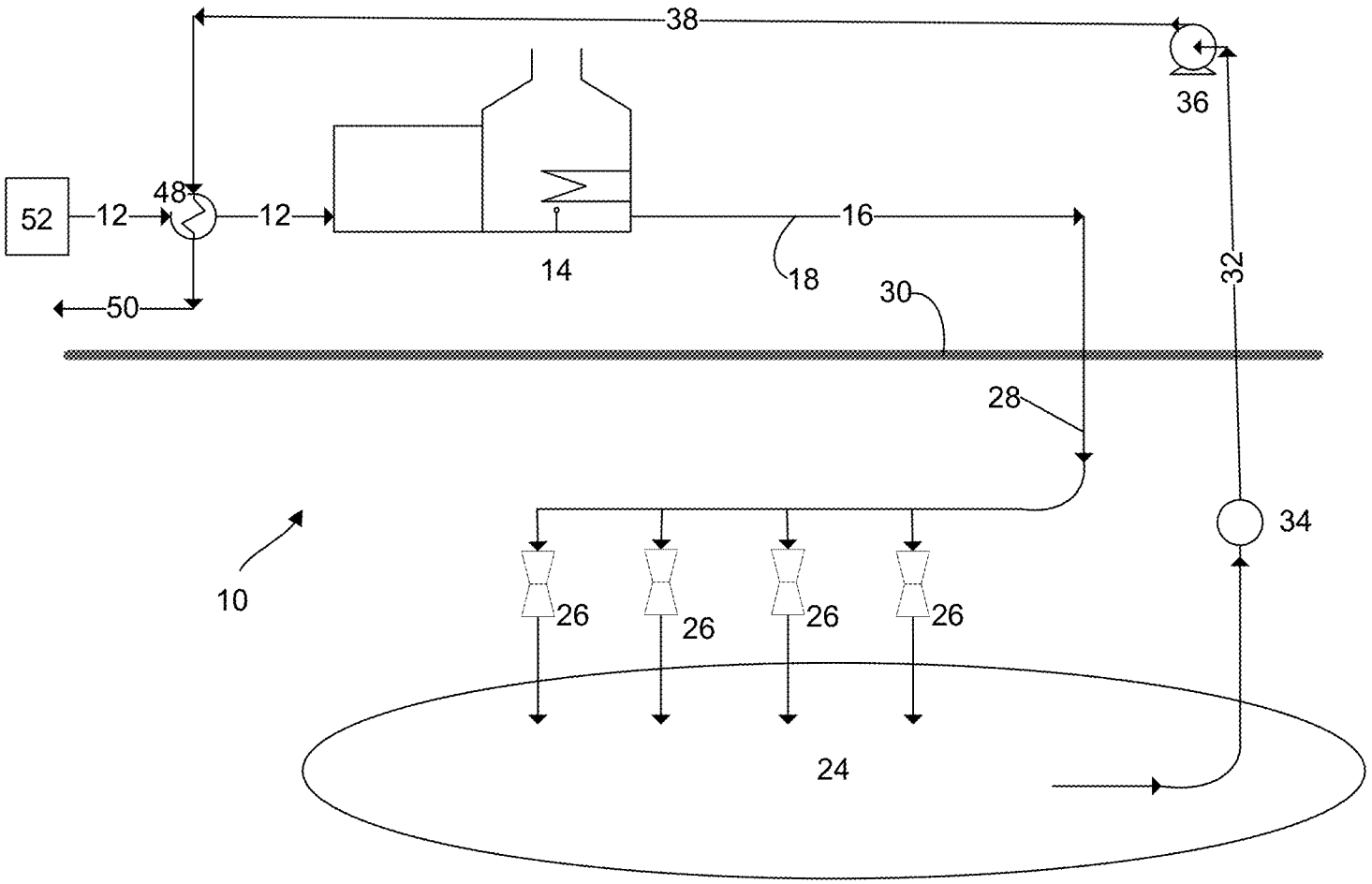
FIG. 2 is a schematic illustration of a system according to another embodiment of the present disclosure, configured to omit an upgrading operation illustrated in FIG. 1.

In other embodiments of the present disclosure, the upgrading aspect described above can be accomplished in other manners. For example, the pipeline feed stream 22 can be provided separately from the reservoir feed stream 20 and/or by a separate heating device. Alternatively, the upgrading operation that is illustrated in FIG. 1 can be omitted from the system 10. For example, the system 10 illustrated in FIG. 2 is configured to provide the stream 16 as the reservoir feed stream, i.e., without splitting the stream 16 to provide a pipeline feed stream 22. The system of FIG. 2 also omits the heat exchanger 40 of FIG. 1. The stream 38 is not combined with a stream of supercritical water but is instead provided to the heat exchanger 48 for pre-heating the feed water 12. The stream 38 then exits the heat exchanger 48 and can be transported to a refinery for upgrading and/or further processing.

Many modifications and other embodiments of the present disclosure set forth herein will come to mind to one skilled in the art to which the present disclosure pertains having the benefit of the teachings presented in the foregoing descriptions and the associated drawings. Therefore, it is to be understood that the present disclosure is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A process for recovering hydrocarbons, comprising:

providing a first supercritical dense phase fluid consisting essentially of water to an underground hydrocarbon reservoir bearing hydrocarbons, wherein the first supercritical dense phase fluid consisting essentially of water is generated by heating water to a supercritical dense phase at a temperature from 374° C. to 1000° C. and a pressure from 3205 to 10000 psia in an oilfield water heater at a surface location, wherein the oilfield water heater has a capacity in a range of about 50 to 150 mmbtu/hr;

injecting the first supercritical dense phase fluid directly into the underground hydrocarbon reservoir via a wellbore to heat the hydrocarbons of the underground hydrocarbon reservoir to reduce viscosity of at least a portion of the hydrocarbons of the underground hydrocarbon reservoir, wherein the step of injecting the first supercritical dense phase fluid comprises delivering the first supercritical dense phase fluid through one or more venturi chokes installed in a wall of the wellbore to the underground hydrocarbon reservoir such that the first supercritical dense phase fluid drops in pressure and flashes across the one or more venturi chokes to a range of about 70% to 100% steam quality or superheated steam; and recovering the heated hydrocarbons from the underground hydrocarbon reservoir.

2. A process according to claim 1, wherein the underground hydrocarbon reservoir is a sandstone, diatomite, shale containing oil, carbonate, or tar sand.

3. A process according to claim 1, wherein the first supercritical dense phase fluid essentially consisting of water that was drinking water, treated wastewater, untreated wastewater, river water, lake water, seawater, produced water or their mixtures.

4. A process according to claim 1, further comprising: mixing a second supercritical dense phase fluid consisting essentially of water with the recovered hydrocarbons to upgrade at least a portion of the recovered hydrocarbons, wherein the step of upgrading includes reducing the viscosity of at least a portion of the recovered hydrocarbons.

5. A process according to claim 4, wherein the upgrade has a reaction residence time from 8 minutes to 2 hours.

6. A process according to claim 4, wherein the mixing occurs in at least one of a wellbore or a production pipeline.

7. A process according to claim 4, wherein the first supercritical dense phase fluid and the second supercritical dense phase fluid are generated from a modified oilfield steam generator at a surface location or modified heat recovery steam generator at a surface location.

8. A process according to claim 4, wherein the first supercritical dense phase fluid and the second supercritical dense phase fluid are generated from a modified oilfield steam generator at a surface location.

9. A process according to claim 4, wherein heat is exchanged between the second supercritical dense phase fluid and the recovered hydrocarbons before mixing.

10. A process according to claim 1, wherein the temperature is in a range of about 374° C. to 455° C. and the pressure is from about 3205 to 4060 psia.

11. A process according to claim 1, wherein the first supercritical dense phase fluid is output from the oilfield water heater into a high pressure piping having a diameter in a range of about 6 to 61 cm.

12. A process according to claim 1, wherein the temperature is in a range of 374° C. to 600° C. and the pressure is from 3205 to 7200 psia.

13. A process according to claim 1, wherein the volume ratio of hydrocarbon to supercritical dense phase fluid consisting essentially of water is from 1:0.1 to 1:10.

* * * * *